US005180290A

United States Patent [19]

Green

[11] Patent Number: 5,180,290

[45] Date of Patent: Jan. 19, 1993

[54] FUEL INJECTION PUMPING APPARATUS

[75] Inventor: Alan C. Green, Maidstone, England

[73] Assignee: Lucas Industries, Birmingham, England

[21] Appl. No.: 905,078

[22] Filed: Jun. 24, 1992

Related U.S. Application Data

[63] Continuation of Ser. No. 532,022, May 31, 1990, abandoned.

[30] Foreign Application Priority Data

Jun. 2, 1989 [GB] United Kingdom ..... 8912649

[51] Int. Cl.[5] ..... F02M 39/02; F02D 1/00

[52] U.S. Cl. ..... 417/218; 417/462; 123/450; 123/502

[58] Field of Search ..... 417/218, 221, 222, 289, 417/462; 123/450, 502

[56] References Cited

U.S. PATENT DOCUMENTS 4,080,109 3/1978 Green ..... 417/251
4,138,981 2/1979 Green ..... 123/139
4,619,238 10/1986 Hain ..... 123/502

FOREIGN PATENT DOCUMENTS 1488670 12/1977 United Kingdom ..... 123/502
2174515 3/1986 United Kingdom ..... 123/502

*Primary Examiner*—Richard A. Bertsch
*Assistant Examiner*—Peter Korytnyk
*Attorney, Agent, or Firm*—Abelman Frayne & Schwab

[57] ABSTRACT

A fuel injection pumping apparatus for supplying fuel to a compression ignition engine has a low pressure pump which supplies fuel to a high pressure pump by way of a throttle. The high pressure pump has a piston for varying the timing of delivery of fuel. A first fixed orifice connects the outlet of the low pressure pump to the cylinder containing the piston and a second fixed orifice connects the cylinder with a drain by way of a variable orifice. In parallel with the second fixed orifice is a bypass valve including a valve member responsive to the pressure applied to the piston and which with increasing pressure opens to allow fuel to escape through a further fixed orifice from downstream of the second fixed orifice.

3 Claims, 1 Drawing Sheet

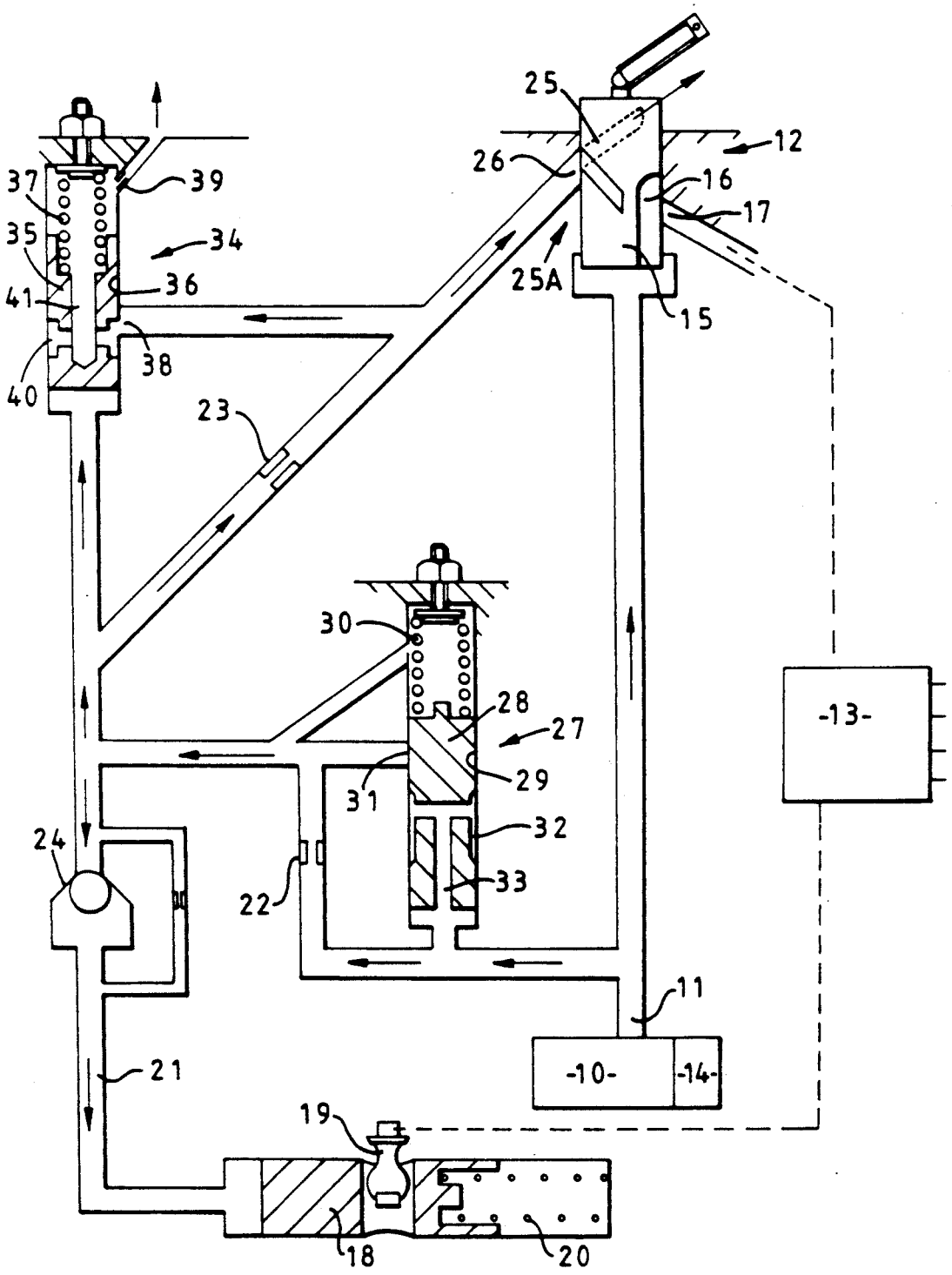
25
12
26
16
17
37
39
35
34
41
36
25A
15
38
40
23
30
28
27
-13-
29
31
32
24
33
22
11
21
-10-
-14-
19
18
20

FUEL INJECTION PUMPING APPARATUS

This application is a continuation of application Ser. No. 532,022, filed May 31, 1990 now abandoned.

BACKGROUND OF THE INVENTION

This invention relates to a fuel injection pumping apparatus for supplying fuel to a compression ignition engine and of the kind comprising a low pressure pump which supplies fuel to a high pressure pump, the output pressure of the low pressure pump varying in accordance with the speed at which the apparatus is driven, a fuel pressure operable device for varying the timing of fuel delivery by the high pressure pump and means for controlling the quantity of fuel which is supplied by the high pressure pump.

It is known that the timing of delivery of fuel to a compression ignition engine must be carefully controlled in order to avoid the emission of noxious exhaust gases.

A known apparatus of the aforesaid kind is seen in GB 2174515B, in which fuel from the low pressure pump flows through a first orifice and then through a second orifice with the pressure developed intermediate the orifices being applied to the pressure operable device. Downstream of the second orifice is a variable orifice through which the fuel can flow to a drain and the degree of restriction offered by the variable orifice is arranged to vary in accordance with the amount of fuel delivered by the high pressure pump, the degree of restriction increasing as the quantity of fuel supplied by the high pressure pump is decreased. Arranged in parallel with the aforesaid variable orifice is a bypass valve which has a valve member responsive to the pressure intermediate the first and second orifices and moving with increasing pressure against the action of a spring to progressively open a bypass passage to drain. The extent of movement of the valve member is limited by an adjustable stop to control the maximum effective size of the bypass passage.

The setting of the adjustable stop is critical for the correct functioning of the apparatus and in some instances it has been found to be very difficult to adjust the setting of the stop.

SUMMARY OF THE INVENTION

The object of the present invention is to provide an apparatus of the kind specified in an improved form.

According to the invention an apparatus of the kind specified further comprises a first orifice through which fuel can flow from the outlet of the low pressure pump, a second orifice connected in series with the first orifice, the pressure intermediate said orifices being applied to the pressure operable device, a variable orifice downstream of said second orifice and through which fuel can flow to a drain, the size of said variable orifice depending on the quantity of fuel delivered by the high pressure pump, with the degree of restriction increasing as the quantity of fuel supplied is decreased, a bypass valve connected in parallel with said variable orifice, said bypass valve including a spring loaded valve member slidable within a cylinder, a passage connecting one end of the cylinder to a point intermediate said first and second orifices so that with increasing pressure the valve member is moved against the action of the spring, a port opening into the wall of the cylinder, the port being connected to a point intermediate the second orifice and said variable orifice, a groove on the periphery of the valve member, said groove communicating with said drain, the groove as the valve member is moved against the action of the spring being brought into register with said port, the apparatus being characterised by a further restricted orifice interposed in the connection between said groove and the drain.

BRIEF DESCRIPTION OF THE PREFERRED EMBODIMENT

FIG. 1 is a diagrammatic representation of an example of an apparatus in accordance with the invention.

DETAILED DESCRIPTION OF THE PREFERRED EMBODIMENT

Referring to the drawing the apparatus comprises a low pressure pump 10 having an outlet 11 which supplies fuel by way of the fuel control means 12 to a high pressure pump 13 the latter having outlets for connection to the injection nozzles of the associated engine. The apparatus may be of the rotary distributor type with the distributor driven in timed relationship with the associated engine and with the rotary part of the low pressure pump connected to the distributor. The outlet pressure of the low pressure pump is controlled by a valve 14 which interconnects the inlet and outlet of the pump.

The fuel control device 12 comprises an angularly adjustable member 15 the angular setting of which in practice is determined by a speed responsive governor. Formed in the member 15 is an axially extending slot 16 which communicates with the outlet 11 of the low pressure pump and can register with a port 17 connected to the inlet of the high pressure pump and formed in the wall of the cylinder in which the member 15 is mounted. As the member is moved angularly so the degree of registration of the slot 16 and port 17 will vary and therefore the amount of fuel which is supplied by the high pressure pump will depend upon the angular setting of the member 15.

The high pressure pump includes a cam which is angularly adjustable to determine the instant at which fuel is delivered through one of the outlets of the high pressure pump and the cam is adjustable by means of a fluid pressure operable piston 18 which is coupled to the cam ring by means of a peg 19. The piston 18 is loaded by a spring 20 in the direction to retard the timing of fuel delivery and fuel under pressure can be applied to the piston to move it against the action of the spring through a passage 21 communicating with the end of the cylinder containing the piston, increasing fuel pressure advancing the timing of fuel delivery to the associated engine.

The apparatus also includes first and second fixed orifices 22, 23, connected in series, with the orifice 22 being located in a passage which is connected to the outlet 11 of the low pressure pump 10. The passage 21 is connected to a point intermediate the orifices 22, 23 by way of a check valve 24 and downstream of the orifice 23 is a variable orifice 25A constituted by a helical groove 25 formed on the wall of the member 15. One end of the groove 25 extends beyond the end of the cylinder into which the member 15 is mounted and communicates with the interior of the housing of the apparatus which can be regarded as being at drain pressure. As the member 15 is moved angularly to vary the quantity of fuel which is supplied to the engine the registration of the groove 25 with a port 26 in the wall of the cylinder in which the member is mounted, varies and it is arranged that the smaller the amount of fuel supplied to the high pressure pump, the greater will be the degree of restriction to the flow of fuel between the port and the groove 25.

Associated with the orifice 22 is a control valve 27 which includes a spring loaded valve member 28 slidable within a cylinder 29. One end of the cylinder is in communication with the outlet 11 of the low pressure pump and the valve member is biased towards this end of the cylinder by means of a coiled compression spring 30. The other end of the cylinder is connected to the downstream side of the orifice 22 and also connected to the downstream side of the orifice 22 is a port 31 opening into the wall of the cylinder 29 intermediate the ends thereof. For registration with the port 31 there is provided on the periphery of the valve member a circumferential groove 32 which is in constant communication with the outlet of the low pressure pump by way of an axial drilling 33 formed in the valve member.

There is also provided a bypass valve 34 and this includes a valve member 35 slidable within a cylinder 36 one end of the cylinder being connected to a point intermediate the orifices 22 and 23. The valve member is biased towards this end of the end of the cylinder by means of a coiled compression spring 37 and opening into the wall of the cylinder is a port 38 which communicates with the downstream side of the orifice 23. The other end of the cylinder is connected to the interior of the housing of the apparatus by way of a restricted orifice 39 and formed in the periphery of the valve member is a circumferential groove 40 which communicates with the aforesaid other end of the cylinder by way of a drilling 41 formed in the valve member. The groove 40 as the valve member moves against the action of its spring, progressively uncovers the port 38.

In operation, and considering firstly that the member 15 is set to allow the maximum flow of fuel to the high pressure pump so that there is a minimum of resistance to fuel flow along the groove 25. At low engine speeds the valve members 28 and 35 of the valves 27 and 34 assume positions at the ends of the respective cylinders and fuel from the low pressure pump flows through the orifices 22 and 23 which are connected in series, from the outlet 11 of the low pressure pump to the interior of the housing. The pressure which is applied to the piston 18 is therefore the outlet pressure of the low pressure pump minus the pressure drop across the orifice 22. As the engine speed continues to increase the output pressure of the low pressure pump will also increase and an increasing pressure will be applied to the piston 18. This pressure is also effective on the valve member 35 and can move this valve member against the action of the spring 37. Such movement however will have no effect upon the pressure applied to the piston since the downstream side of the orifice 23 is already in communication with the interior of the housing through the port 26 and groove 26 and the fact that the port 38 is uncovered is largely immaterial. However, as the output pressure of the low pressure pump increases as the engine speed increases, there will be an increase in the pressure drop across the orifice 22 and eventually the pressure drop will become sufficiently large to cause movement of the valve member 28 against the action of the spring 30. A point will be reached at which the groove 32 is uncovered to the port 31 and the valve 27 then acts as a constant pressure drop valve so that the pressure which is applied to the piston 18 corresponds to the outlet pressure of the low pressure pump minus a constant value determined by the valve 27. The pressure of fuel applied to the piston 18 therefore increases at a rate which is less than the rate of increase of the output pressure of the pump 10 but when the valve 27 becomes operative the pressure increases at the same rate.

Considering now light load operation of the engine with the member 15 at a position such that minimum fuel is supplied to the engine. In this position the groove 25 no longer communicates with the port 26. At low engine speeds the valve members 28, 35 of the two valves will have moved their maximum extent under the action of their springs. Since the port 26 is closed no flow of fuel can take place and therefore at low speeds the pressure which is applied to the piston 18 corresponds to the outlet pressure of the low pressure pump. As the engine speed and therefore the pressure increases the valve member 35 will move against the action of its spring and after a predetermined movement the groove 40 will start to uncover the port 38. When this occurs fuel can start to flow through the orifice 23 and the valve 34 acts to maintain the pressure which is applied to the piston 18 substantially constant. Fuel will also flow through the orifice 39 but the size of this orifice is large as compared with the orifice formed by the groove 40 and port 38, at least in the initial stages of movement of the valve member 35. With continued movement of the valve member 35 the size of the orifice formed by the groove 40 and port 38 becomes comparable with that of the orifice 39 and the valve 34 will no longer act to maintain the fuel pressure acting on the piston 18 substantially constant. As therefore the outlet pressure of the low pressure pump continues to increase the pressure applied to the piston 18 will also increase. The increasing pressure drop across the orifice 22 will eventually cause movement of the valve member 28 to allow the groove 32 to move into register with the port 31. The valve 27 will then act as previously described, as a constant pressure drop valve. The pressure applied to the piston 10 as the engine speed increases is therefore initially the output pressure of the pump 10. When the valve 34 is functioning the pressure remains substantially constant until with increasing engine speed, the valve 34 ceases to function as a constant pressure drop valve. The pressure applied to the piston then increases at the same rate of increase as the pressure developed by the pump 10.

The two extreme positions for the member 15 have been described above and it will be appreciated that when the member 15 is set to cause an intermediate quantity of fuel flow to the associated engine, there will be a degree of registration between the groove 25 and the port 26. In this case therefore there will be a small flow of fuel through the orifice 23 and hence a pressure drop across this orifice. At low engine speeds therefore because of the flow of fuel through the orifice 23, the pressure which will be applied to the piston 18 will be lower than in the case when the member 15 is set to provide the minimum fuel flow to the associated engine.

It will be appreciated that the orifice 39 can be located in the drilling 41 in the valve member 35 with the end of the cylinder 36 which contains the spring connected by way of an unrestricted passage with the interior of the housing.

I claim:

1. A fuel injection pumping apparatus for supplying fuel to a compression ignition engine comprising a low pressure pump the output pressure of which varies in accordance with the speed at which the apparatus is driven, a high pressure pump, a fuel pressure operable device for varying the timing of fuel delivery by the high pressure pump, means for controlling the quantity of fuel which is supplied by the high pressure pump, a first orifice through which fuel can flow from the outlet of the low pressure pump, a second orifice connected in series with the first orifice, the pressure intermediate said orifices being applied to the pressure operable device a variable orifice downstream of said second orifice and through which fuel can flow to a drain, the size of said variable orifice depending on the quantity of fuel delivered by the high pressure pump, with the degree of restriction increasing as the quantity of fuel supplied is decreased, a bypass valve connected in parallel with said variable orifice, said bypass valve including a spring loaded valve member slidable within a cylinder, a passage connecting one end of the cylinder to a point intermediate said first and second orifices so that with increasing pressure the valve member is moved against the action of the spring, a port opening into the wall of the cylinder, the port being connected to a point intermediate the second orifice and said variable orifice, a groove on the periphery of the valve member, said groove communicating with said drain, the groove as the valve member is moved against the action of the spring being brought into register with said port, the apparatus being characterised by a further restricted orifice interposed in the connection between said groove and the drain.

2. An apparatus according to claim 1 characterised in that said orifice is located in a passage which connects said other end of the cylinder with the drain, said groove being connected to said other end of the cylinder by a passage formed in the valve member.

3. An apparatus according to claim 1 characterised by a passage formed in the valve member said passage connecting said groove to the other end of the cylinder, said orifice being located in the passage and said other end of the cylinder being connected to the drain.

* * * * *